US006367461B1

(12) United States Patent
Wu

(10) Patent No.: US 6,367,461 B1
(45) Date of Patent: Apr. 9, 2002

(54) EXHAUST RECIRCULATING DEVICE, FOR A MOTOR ENGINE

(76) Inventor: Yuan-Tang Wu, No. 55, Da-Ming Rd., Feng-Yuan City, Taichung Hsien (TW)

( * ) Notice: Subject to any disclaimer, the term of this patent is extended or adjusted under 35 U.S.C. 154(b) by 6 days.

(21) Appl. No.: 09/612,013

(22) Filed: Jul. 7, 2000

(51) Int. Cl.[7] ..... F02M 25/07
(52) U.S. Cl. ..... 123/568.15
(58) Field of Search ..... 123/568.11, 568.15

(56) References Cited

U.S. PATENT DOCUMENTS 3,074,390 A * 1/1963 O'Laughlin ..... 123/568.15
4,027,635 A * 6/1977 Goto et al. ..... 123/568.15
4,048,968 A * 9/1977 Aoyama ..... 123/568.15
4,270,508 A * 6/1981 Lindberg ..... 123/568.15
4,593,672 A * 6/1986 Barone ..... 123/568.15
4,796,594 A * 1/1989 Duret ..... 123/568.15

* cited by examiner

*Primary Examiner*—Willis R. Wolfe
(74) *Attorney, Agent, or Firm*—Charles E. Baxley

(57) ABSTRACT

An exhaust recirculating device for a motor engine to which an exhaust pipe and an air inlet pipe are connected. The device includes an air introducing member connected to the exhaust pipe and the air introducing member includes a hollow body and a connection member which extends from a first end of the body. An open end is defined in a second end of the body and a filtering member is engaged with the open end. The connection member has a passage which communicates with an interior in the body. The connection member is connected to the exhaust pipe. An adjustment bolt threadedly and radially extends into the body and a gap is defined between the adjustment bolt and an inside of the passage so as to adjust a volume of air introduced into the body.

1 Claim, 4 Drawing Sheets

EXHAUST RECIRCULATING DEVICE, FOR A MOTOR ENGINE

FIELD OF THE INVENTION

The present invention relates to an exhaust recirculating device for a motor engine, wherein an air introducing member is connected to an exhaust pipe to provide sufficient air and to mix with the exhaust gas from the engine so as to be send into the engine.

BACKGROUND OF THE INVENTION

A conventional exhaust recirculating device for a motor engine is shown in FIG. 1 and generally includes an air inlet pipe 12 and an exhaust pipe which is connected to the air inlet pipe 12 and the engine 10. Exhaust air is generated in the chamber of the engine and enters the exhaust pipe 11. The exhaust air involves gas particles that are not completely burned or not even burned. A ventilation valve 13 is connected to the device so as to provide air to be mixed with the gas particles in the exhaust air and the mixture will be send into the combusting chamber of the engine 10 to be burned again. Nevertheless, the air and the gas particles cannot be properly mixed because there will be no sufficient air being introduced so that when the mixture of the gas particles of the exhaust is mixed with the gas from the gas tank, the ratio of the gas and the air will not be proper and the efficiency of the engine performance is reduced.

The present invention intends to provide an improved exhaust recirculating device for a motor engine wherein the device has an air introducing member that introduces sufficient fresh air to be mixed with the gas particles in the exhaust air so that when the mixture is sent into the engine, the combustion condition in the engine is maintained in a normal condition.

SUMMARY OF THE INVENTION

In accordance with one aspect of the present invention, there is provided an exhaust recirculating device for a motor engine to which an exhaust pipe and an air inlet pipe are connected. The exhaust pipe communicates with the air inlet pipe and a ventilation valve is connected to the exhaust pipe. The exhaust recirculating device comprises an air introducing member connected to the exhaust pipe and the air introducing member includes a hollow body and a connection member which extends from a first end of the body. An open end is defined in a second end of the body and a filtering member is engaged with the open end. The connection member has a passage which communicates with an interior in the body. The connection member is connected to the exhaust pipe. An adjustment bolt threadedly and radially extends into the body and a gap is defined between the adjustment bolt and an inside of the passage so as to adjust a volume of air introduced into the body.

The object of the present invention is to provide a circulation device connected to an exhaust pipe from the engine and the device introduces sufficient air to be mixed with the gas particles in the exhaust air so that the mixture can be sent into the engine to be burned again.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
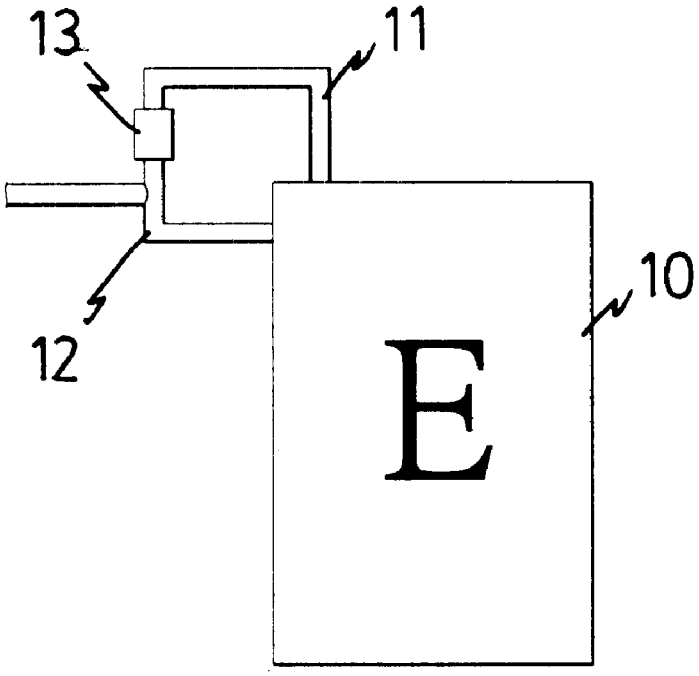
FIG. 1 PRIOR ART
FIG. 1 is an illustrative view to show a conventional exhaust recirculating device for a motor engine.
Figure 2:
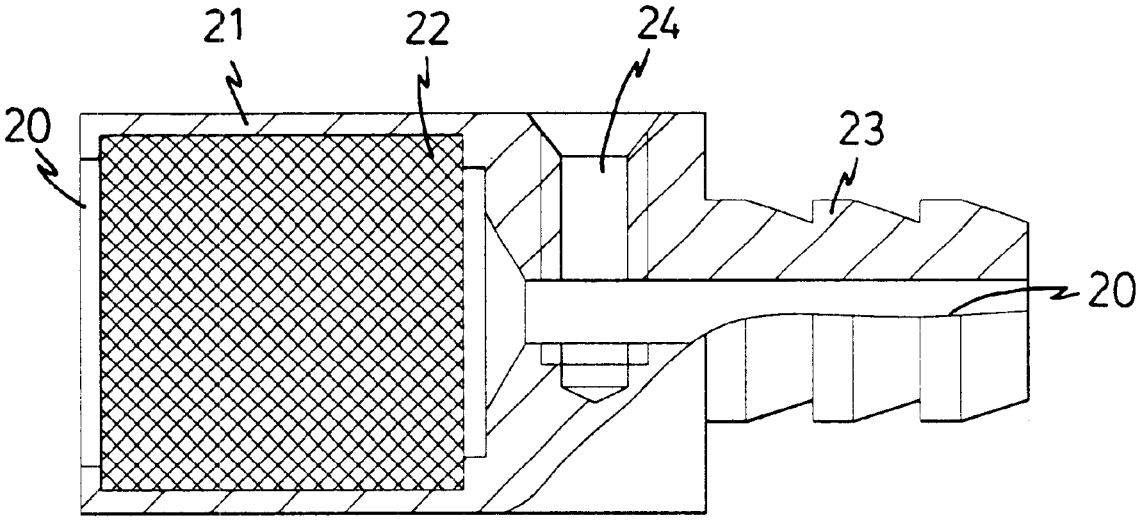
FIG. 2 is a cross sectional view to show an air introducing member of the exhaust recirculating device of the present invention.
Figure 3:
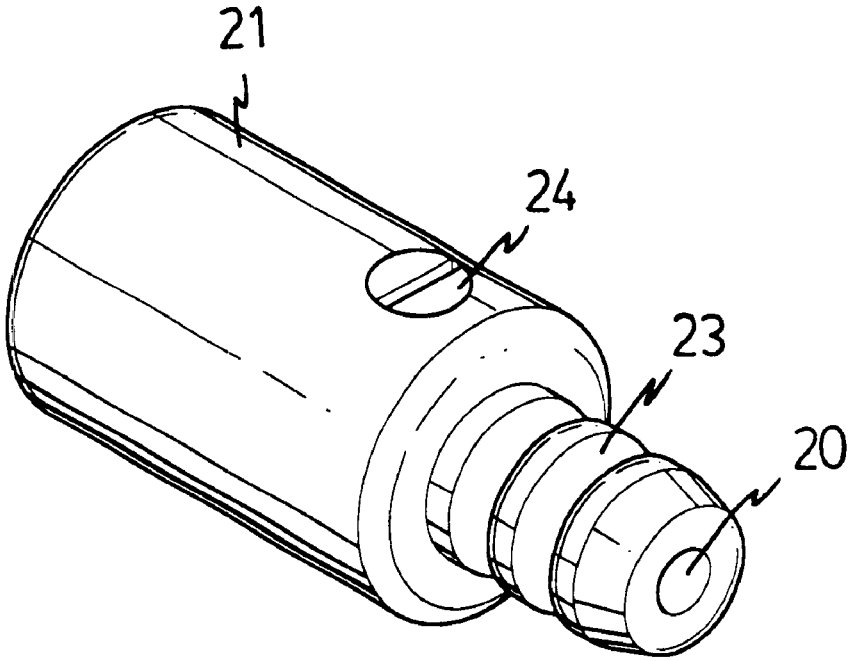
FIG. 3 is a perspective view to show the air introducing member of the exhaust recirculating device of the present invention.
Figure 4:
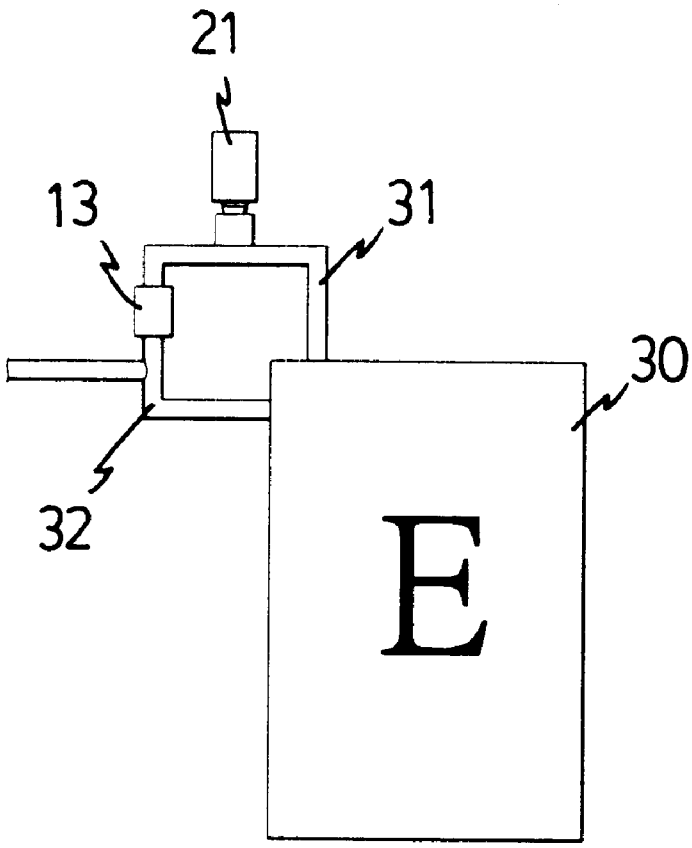
FIG. 4 is a cross sectional view to show the arrangement of the exhaust recirculating device of the present invention.

Referring to FIGS. 2 to 4, in a system for a motor engine, there are an exhaust pipe 31 and an air inlet pipe 32 are connected. The exhaust pipe 31 communicates with the air inlet pipe 32 and a ventilation valve 13 is connected to the exhaust pipe 31. An exhaust recirculating device of the present invention comprises an air introducing member 20 connected to the exhaust pipe 31 and comprises a hollow body 21. A connection member 23 extends from a first end of the body 21 and an open end is defined in a second end of the body 21. A filtering member 22, such as a netted screen, is engaged with the open end of the body 21. The connection member 23 is a tubular member and a passage 20 is defined through the connection member 23. The passage 20 communicates with an interior in the body 21. The connection member 23 has a plurality of annular flanges extending radially outward from an outer periphery thereof and each flange has a tapered outer periphery so that the connection member 23 is easily connected to a fitting in the exhaust pipe 31. An adjustment bolt 24 is threadedly and radially extending into the connection member 23 and a gap is defined between the adjustment bolt 24 and an inside of the passage 231. The gap can be adjusted by threading the bolt 24 and fresh air is therefore sucked via the gap to mix with the gas particles in the exhaust pipe 31.

The recirculating device of the present invention can also be used between the brake pump and inlet manifold to increase the brake force applied to the brake mechanism of a vehicle.

While we have shown and described various embodiments in accordance with the present invention, it should be clear to those skilled in the art that further embodiments may be made without departing from the scope and spirit of the present invention.

What is claimed is:

1. An exhaust recirculating device for a motor engine to which an exhaust pipe and an air inlet pipe are connected, the exhaust pipe communicating with the air inlet pipe and a ventilation valve connected to said exhaust pipe, said exhaust recirculating device comprising:

an air introducing member adapted to be connected to the exhaust pipe and comprising a hollow body and a connection member extending from a first end of said body, an open end defined in a second end of said body and a filtering member engaged with said open end of said body, said connection member having a passage defined therethrough and said passage communicating with an interior in said body, said connection member adapted to be connected to the exhaust pipe, an adjustment bolt threadedly and radially extending into said connection member and a gap defined between said adjustment bolt and an inside of said passage, said connection member having a plurality of annular flanges and each flange having a tapered outer periphery.

* * * * *